US006216296B1

(12) United States Patent
Carrasco

(10) Patent No.: US 6,216,296 B1
(45) Date of Patent: Apr. 17, 2001

(54) APPARATUS OPERABLE AS VESTMENT AND LITTER

(76) Inventor: Armando Carrasco, 5822 S. 9th St., Phoenix, AZ (US) 85040

( * ) Notice: Subject to any disclaimer, the term of this patent is extended or adjusted under 35 U.S.C. 154(b) by 0 days.

(21) Appl. No.: 09/304,493

(22) Filed: May 3, 1999

(51) Int. Cl.[7] ..... A61G 1/00; A45F 4/06

(52) U.S. Cl. ..... 5/625; 5/627; 5/628; 2/108; 224/156

(58) Field of Search ..... 5/625, 626, 627, 5/628; 2/94, 108, 93, 69, 69.5; 224/153, 156, 651, 158, 159

(56) References Cited

U.S. PATENT DOCUMENTS

| | | | | |
|---|---|---|---|---|
| 263,819 | * | 9/1882 | Shannon | 5/627 X |
| 850,312 | * | 4/1907 | Norwood | 2/94 |
| 919,159 | * | 4/1909 | Goddard | 5/628 |
| 1,068,016 | * | 7/1913 | Stone | 5/627 |
| 1,263,918 | * | 4/1918 | Miller | 5/625 X |
| 1,541,060 | * | 6/1925 | Martin | 224/156 |
| 2,899,692 | * | 8/1959 | Finken | 5/628 |
| 2,940,443 | * | 6/1960 | Baker | 2/69 X |
| 2,964,222 | * | 12/1960 | Rainwater | 224/156 |
| 3,336,060 | * | 8/1967 | Bradford | 5/628 X |
| 3,426,367 | * | 2/1969 | Bradford | 5/628 X |
| 3,601,824 | * | 8/1971 | Bradford | 5/628 |
| 3,730,407 | * | 5/1973 | Russell | 224/156 |
| 3,828,992 | * | 8/1974 | Cerchione | 224/156 |
| 3,886,606 | * | 6/1975 | Bradford | 5/628 X |
| 3,986,505 | * | 10/1976 | Power | 5/625 X |
| 4,124,908 | * | 11/1978 | Burns et al. | 5/628 |
| 4,511,071 | * | 4/1985 | Curran | 224/156 |
| 4,538,750 | * | 9/1985 | Hanna | 224/156 |
| 4,563,777 | * | 1/1986 | Park | 2/108 |
| 4,885,812 | * | 12/1989 | Lindner | 224/156 X |
| 4,949,401 | * | 8/1990 | Kimsey, Jr. | 2/108 X |
| 4,970,739 | * | 11/1990 | Bradford | 5/625 |
| 5,165,111 | * | 11/1992 | Lieberman | 2/108 X |
| 5,699,568 | * | 12/1997 | Couldridge | 5/628 |

FOREIGN PATENT DOCUMENTS

| | | | | |
|---|---|---|---|---|
| 91266 | * | 3/1897 | (DE) | 224/156 |
| 639964 | * | 12/1936 | (DE) | 224/156 |
| 7762 | * | of 1914 | (GB) | 224/156 |
| 2181640 | * | 4/1987 | (GB) | 224/153 |
| 181679 | * | 11/1962 | (SE) | 5/627 |

* cited by examiner

*Primary Examiner*—Brian K. Green
*Assistant Examiner*—Robert G. Santos
(74) *Attorney, Agent, or Firm*—Jordan M. Meschkow; Lowell W. Gresham; Meschkow & Gresham, P.L.C.

(57) ABSTRACT

An apparatus (20) operable as both a vestment (22) and a litter (24) is provided. The apparatus (20) has a flexible back panel (26) serving as a back (28) for the vestment (22) and as a bed (30) for the litter (24). A front (40) of the vestment (22) is made up of a flexible left front panel (42), a flexible right front panel (44), and a fastener (46). The apparatus (20) includes a pair of sectioned support poles (54). When the apparatus (20) is configured as a litter (24), a cross member (58) is removably coupled between the support poles (54), and a support device (112) supports the bed (30) of the litter (24) from the support poles (54). A safety strap (60) secures a victim (124) to the bed (30) for transport.

5 Claims, 6 Drawing Sheets

90

20 24 140

APPARATUS OPERABLE AS VESTMENT AND LITTER

TECHNICAL FIELD OF THE INVENTION

The present invention relates to the field of clothing. More specifically, the present invention relates to clothing convertible to other articles.

BACKGROUND OF THE INVENTION

Should an individual fall victim to illness or injury in the field, it is often necessary to transport the victim a considerable distance before treatment may be rendered. For example, if a hunter in a remote area were to be injured, it may be necessary to transport that hunter several miles over rough terrain before medical assistance, other than first aid, may be administered.

The need for such emergency medical transport requires that that transport be immediately provided. A delay or failure in providing transport may result in a worsening of the illness or injury. In extreme cases, this worsening may result in the death of the victim.

The need to provide immediate medical transport requires preplanning for such a medical emergency. This preplanning implies that a means for transport be present or produced at the scene of the emergency.

Typically, a litter, such as a stretcher, is used to transport a victim. Such a litter is normally made up of a canvas or other flexible material stretched over a frame consisting of two poles and two cross members. The carrier of such a litter is encumbered with a considerable burden. The overall mass of the litter adds significantly to the load of the carrier, and the length of the poles inhibit the activities in which the carrier may engage. Collapsing the litter, i.e., disengaging the cross members to allow the poles and flexible material to be wrapped into a tighter bundle, neither shortens the length of the poles nor ameliorates the mass of the litter.

As a result, informal field outings, such as for hunting, backpacking, etc., often omit the litter as too burdensome, thus increasing significantly the difficulty of providing immediate transport in the event of an emergency and significantly increasing the risk of complication and death to a potential victim.

What is needed, therefore, is a litter capable of being carried in the field in anticipation of a possible emergency with a minimum of difficulty and inconvenience to the individual doing the carrying. Such a litter should be lightweight, small in size, and carryable without interfering with the normal activities of the carrier.

SUMMARY OF THE INVENTION

Accordingly, it is an advantage of the present invention that an apparatus operable as a vestment and a litter is provided.

It is another advantage of the present invention that an apparatus is provided that is operable as a litter and transportable as a vestment.

It is another advantage of the present invention that an apparatus is provided that is operable as a litter and has sectional support poles.

The above and other advantages of the present invention are carried out in one form by an apparatus operable as both a vestment and a litter. This apparatus is formed of a first flexible panel serving as both a back of the vestment and as bed of the litter, a second flexible panel coupled to the first flexible panel and configured as a front of the vestment, a pair of support poles, and a support device coupled to the first flexible panel to support the first flexible panel from the support poles when the apparatus is configured as a litter.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 2:
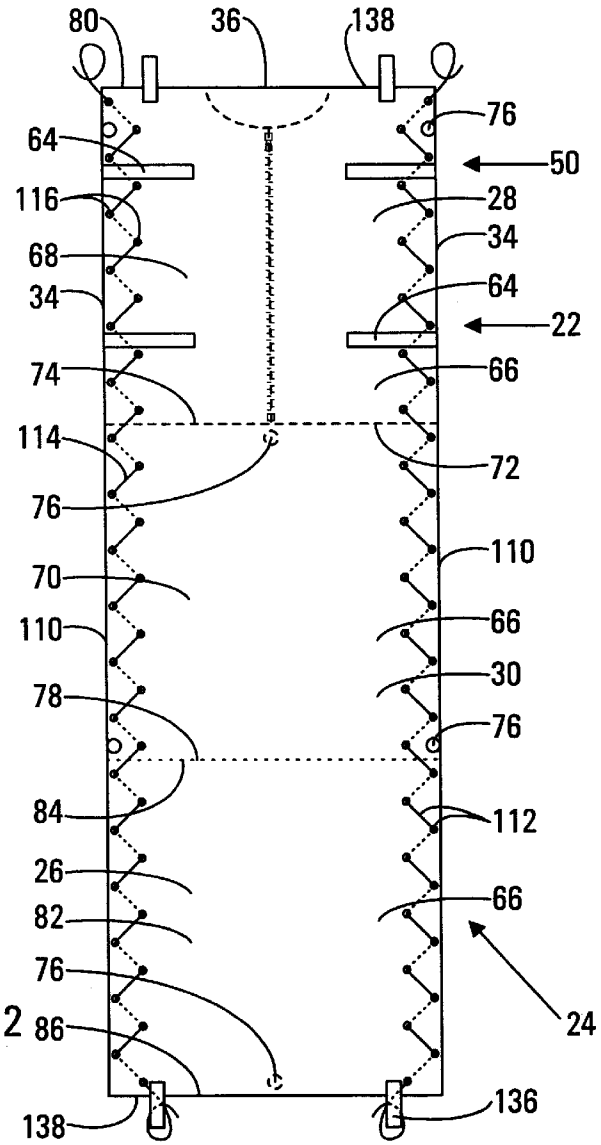
FIG. 2 depicts a back view of an apparatus, less support poles, operable as a sleeveless vestment and a lace-supported litter in accordance with a preferred embodiment of the present invention.
Figure 1:
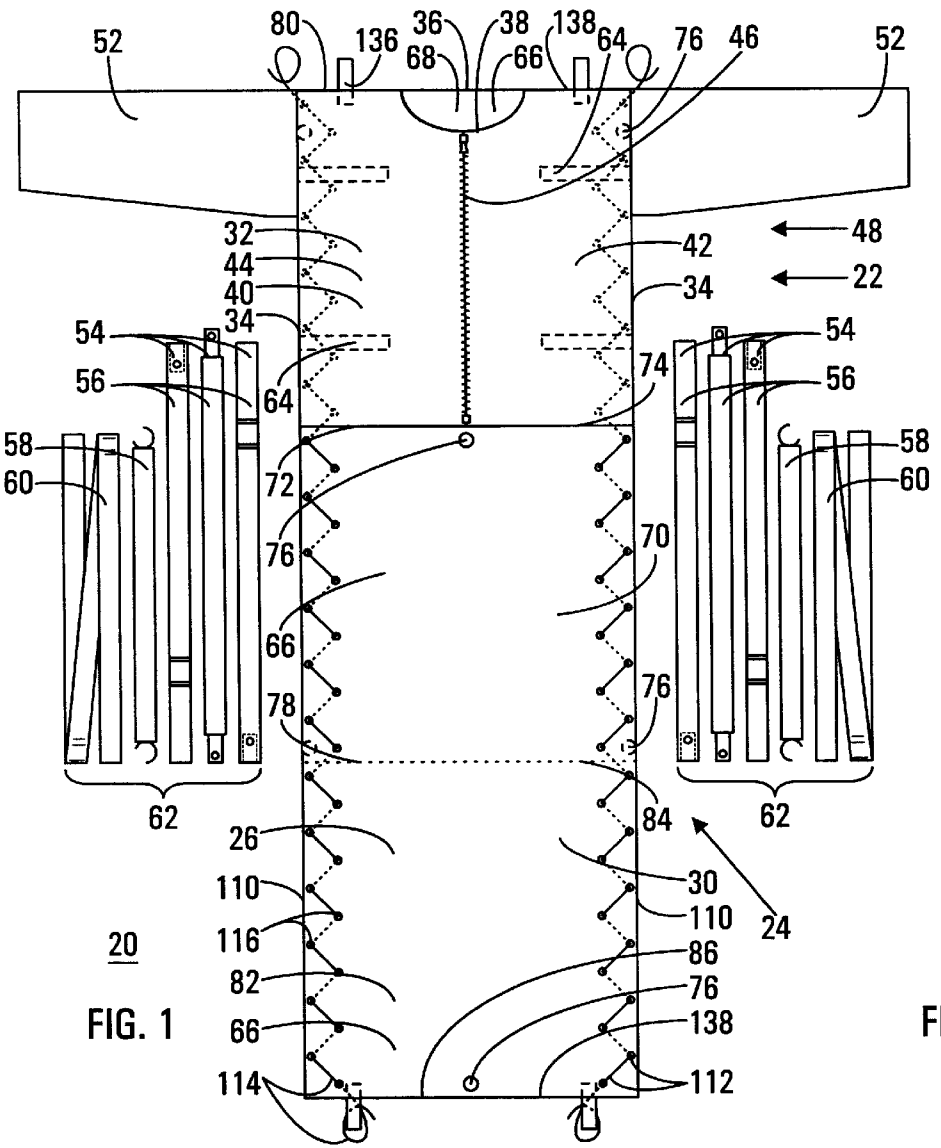
FIG. 1 depicts a front view of an apparatus operable as a sleeved vestment and a lace-supported litter in accordance with a preferred embodiment of the present invention.

FIG. 1 depicts a front view of an apparatus 20 operable as a sleeved embodiment of a vestment 22 and a litter 24, and FIG. 2 depicts a back view of apparatus 20 operable as a sleeveless embodiment of vestment 22 and litter 24, in accordance with a preferred embodiment of the present invention. The following discussion refers to FIGS. 1 and 2.

Apparatus 20 has a rear flexible panel 26. Depending upon the configuration of apparatus 20, rear flexible panel 26 serves as a back 28 of vestment 22 or a bed 30 of litter 24. In the preferred embodiment, rear flexible panel 26 is made of a strong fabric, such as canvas, denim, or nylon. Those skilled in the art will appreciate that other materials may be used for rear flexible panel 26.

Apparatus 20 also has a front flexible panel 32 coupled to rear flexible panel 26 along both sides 34 and across a top 36, leaving arm openings (not shown) in sides 34 and a neck opening 38 in top 36, to form vestment 22. Front flexible panel 32 forms a front 40 of vestment 22.

In the preferred embodiment, front flexible panel 32 is made of the same fabric as rear flexible panel 26. Those skilled in the art will appreciate that this is not a requirement of the present invention, and front flexible panel 32 may be made of a different material than rear flexible panel 26. For example, rear flexible panel 26 may be made of rayon for strength and weight, while front flexible panel may be made of cotton for comfort.

In the preferred embodiment, front flexible panel 32 is made up of a left front panel 42 and a right front panel 44, which are removably coupled by a fastener 46 to form vestment front 40. Those skilled in the art will appreciate that vestment front 40 may be openable, as depicted, in which case vestment 22 is realized as a jacket 48 (FIG. 1) or a vest 50 (FIG. 2). Alternatively, vestment front 40 may be formed of a single unopenable piece (not shown), in which case vestment 22 is realized as a pullover garment (not shown). The use of alternative forms for vestment 22 does not depart from the spirit of the present invention.

Similarly, fastener 46 is depicted in the Figures as a zipper. Alternative fasteners, such as snaps, buttons, hook-and-loop closures, etc., may be used without departing from the spirit of the present invention.

Vestment 22 may be embodied as vest 50 (FIG. 2). By the addition of sleeves 52 (FIG. 1), vestment 22 may be embodied as jacket 48 (FIG. 1). Those skilled in the art will appreciate that the specific embodiment of vestment 22 is immaterial to the spirit of the present invention. Indeed, front 40 may be realized as straps or other devices for positioning and supporting back 28, vestment 22, and apparatus 20 without departing from the spirit of the present invention.

In the preferred embodiment of FIG. 1, sleeves 52 are made of the same fabric as front flexible panel 32. Those skilled in the art will appreciate that this is not a requirement of the present invention, and sleeves 52 may be made of any practicable material without departing from the spirit of the present invention.

Figure 5:
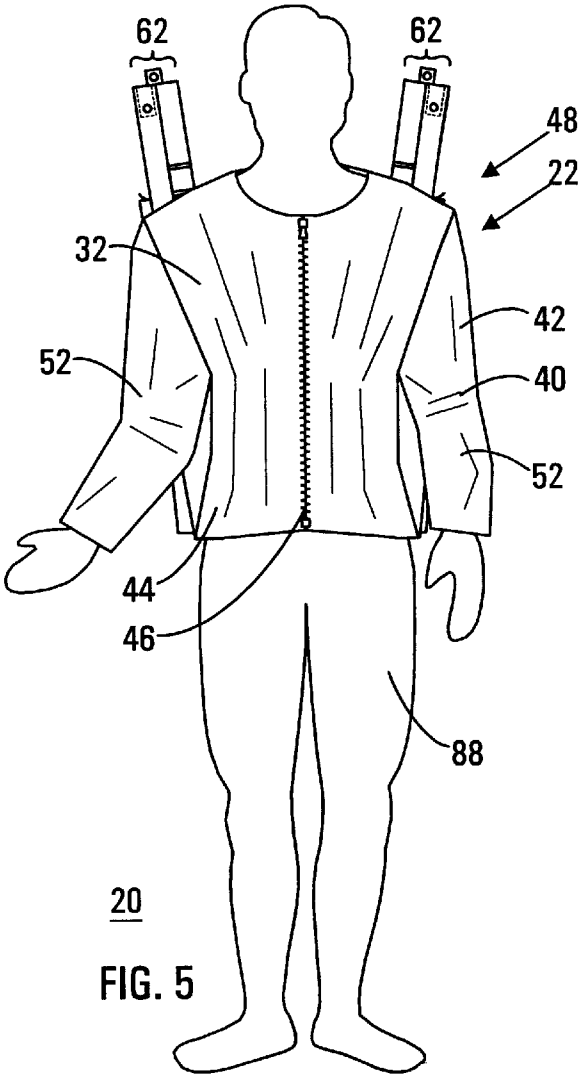
FIG. 5 depicts a front view of an apparatus operable as a vestment and a litter in use as a jacket in accordance with a preferred embodiment of the present invention.
Figure 4:
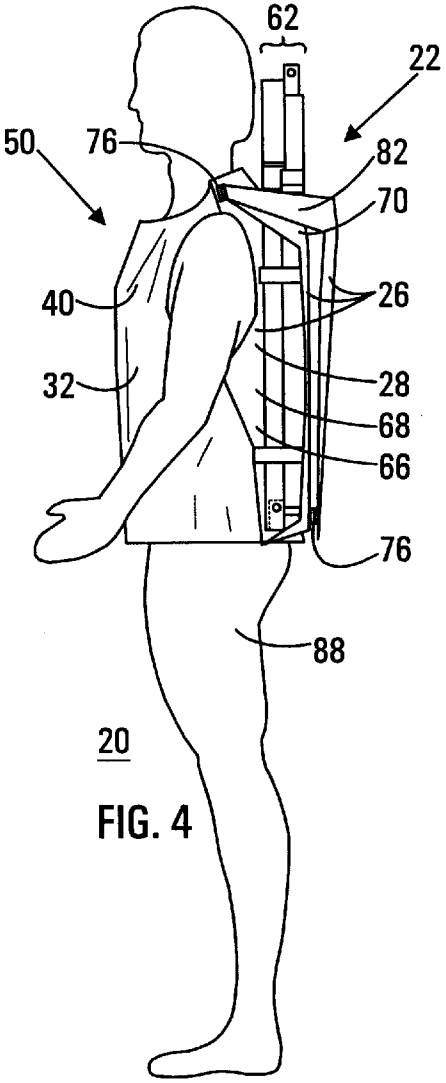
FIG. 4 depicts a side view of an apparatus operable as a vestment and a litter in use as a vest in accordance with a preferred embodiment of the present invention.
Figure 3:
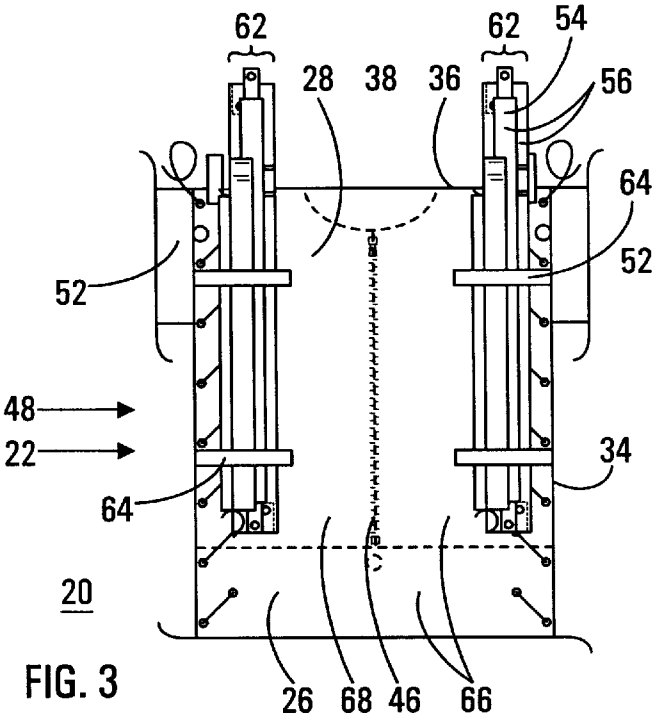
FIG. 3 depicts a partial back view of the apparatus of FIG. 1 with sectional support poles in position for operation as a jacket in accordance with a preferred embodiment of the present invention.

In accordance with preferred embodiments of the present invention, FIG. 3 depicts a partial back view of apparatus 20 of FIG. 1 with sectional support poles 54 in position for operation as jacket 48, FIG. 4 depicts a side view of apparatus 20 of FIG. 2 in use as vest 50, and FIG. 5 depicts a front view of apparatus 20 of FIG. 1 in use as jacket 48. The following discussion refers to FIGS. 1, 2, 3, 4, and 5.

Apparatus 20 includes support poles 54 in sections 56, cross members 58, and safety straps 60. When apparatus 20 is configured as vestment 22, pole sections 56, cross members 58, and safety straps 60 are gathered into bundles 62 and coupled to back 28 of vestment 22 by bundling devices 64. In the preferred embodiment, bundling devices 64 are straps fixedly attached to vestment sides 34, wrapped around bundles 62, and removably coupled to back 28 by hook-and-loop closures (not shown). Those skilled in the art will appreciate that other forms of bundling devices 64, such as laces, elastic loops, etc., may be used without departing from the spirit of the present invention. Similarly, while FIGS. 3, 4, and 5 depict bundles 62 as being coupled to back 28 in substantially vertical positions, those skilled in the art will appreciate that bundles 62 may be positioned horizontally or diagonally where functionality so dictates.

In the preferred embodiment, rear flexible panel 26 is formed of three sub-panels 66. Sub panels 66 are contiguous. That is, sub-panels 66 may be formed of three independent pieces of material sewn or otherwise attached together in a manner intended to be permanent for normal uses of apparatus 20, may be formed of a single continuous piece of material arbitrarily divided into sub-panels 66, or any combination thereof so that sub-panels 66 are fixedly coupled together. The positional relationships between sub-panels 66 are as discussed hereinbelow.

A first sub-panel 68 forms back 28 of vestment 22. Front 40, sleeves 52 (when used), and bundling devices 64 are coupled to first sub-panel 68.

A second sub-panel 70 depends from first sub-panel 68. An upper edge 72 of second sub-panel 70 is fixedly coupled to a lower edge 74 of first sub-panel 68. This arrangement allows second sub-panel 70 to be folded up and over first sub-panel 68 and bundles 62 coupled thereto (see FIG. 4). Mating fasteners 76 are used to removably couple and maintain a lower (when free hanging) edge 78 of second sub-panel 70 proximate an upper edge 80 of first sub-panel 68. In this manner, the interface between first sub-panel 68 and second sub-panel 70 form the bottom of a "backpack" whose front is first sub-panel 68 (i.e., vestment back 28), whose back is second sub-panel 70, and whose sides are bundles 62. The space enclosed by this backpack forms a pocket in which to carry first aid supplies or other goods (not shown). Those skilled in the art will appreciate that other devices to retain such goods may be coupled to either first or second sub-panels 68 or 70 without departing from the spirit of the present invention.

In the embodiments of FIGS. 1 through 5, a third sub-panel 82 depends from second sub-panel 70 when second sub-panel 70 is free hanging. An upper edge 84 of third sub-panel 82 is fixedly coupled to lower edge 78 of second sub-panel 70. This arrangement allows third sub-panel 82 to be folded down and over second sub-panel 68 when second sub-panel 70 is folded up and over first sub-panel 68 (see FIG. 4). Mating fasteners 76 are used to removably couple and maintain a lower edge 86 of third sub-panel 82 proximate upper edge 72 of second sub-panel 70. This keeps third sub-panel 82 out of the way when apparatus 20 is engaged in normal operation as vestment 22.

In the preferred embodiments, mating fasteners 76 are snaps. Those skilled in the art will appreciate that many other forms of fasteners 76 may be used without departing from the spirit of the present invention.

The preferred embodiment depicted in FIG. 4 demonstrates apparatus 20 configured as vest 50 and being worn by a wearer 88. Similarly, the preferred embodiment of FIG. 5 demonstrates apparatus 20 configured as jacket 48 and being worn by wearer 88. In an alternative embodiment (not shown) third sub-panel 82 may be configured as a hood and worn over the head of wearer 88 as protection from precipitation, wind, sunlight, insects, etc. Variant arrangements of sub-panels 66 may be used in other embodiments, including, but not limited to, the embodiments depicted in FIGS. 14 and 15 (discussed hereinbelow).

Figure 6:
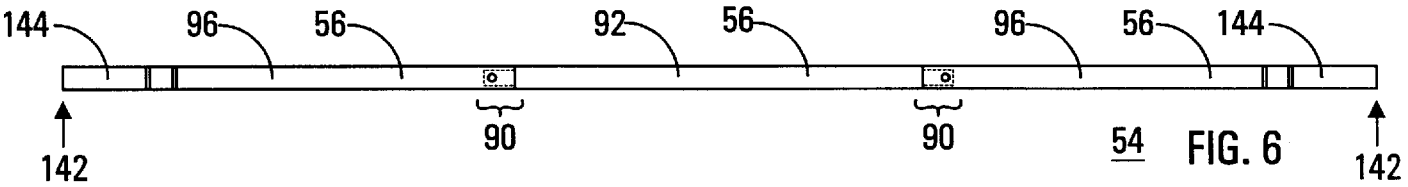
FIG. 6 depicts a side view of an assembled bayonet-coupled support pole in accordance with a preferred embodiment of the present invention.
Figure 7:
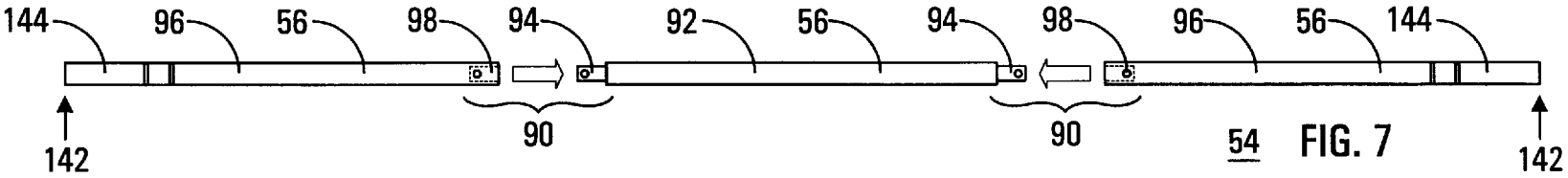
FIG. 7 depicts an exploded side view demonstrating the assembly of the support pole of FIG. 6 in accordance with a preferred embodiment of the present invention.
Figure 9:
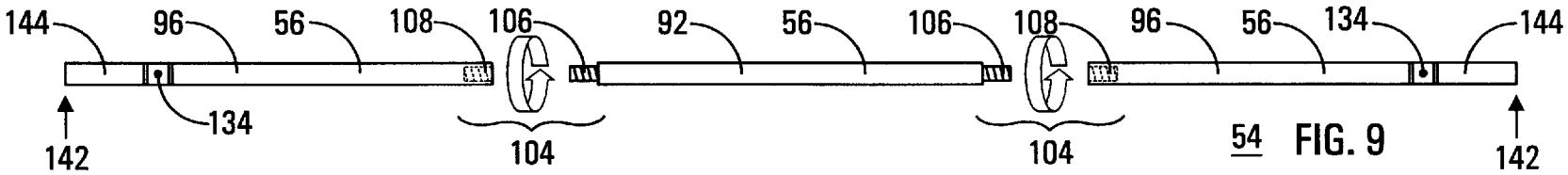
FIG. 9 depicts an exploded side view demonstrating the assembly of a screw-coupled support pole in accordance with an alternative embodiment of the present invention.
Figure 8:
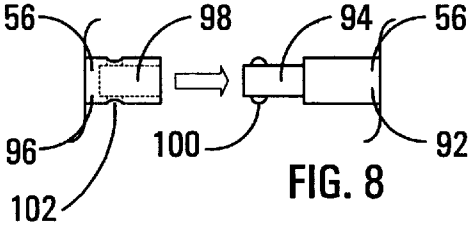
FIG. 8 depicts an exploded top view demonstrating the coupling of two sections of the support pole of FIG. 6 in accordance with a preferred embodiment of the present invention.

FIG. 6 depicts a side view of an assembled bayonet-coupled support pole 54, FIG. 7 an exploded side view demonstrating the assembly of support pole 54 of FIG. 6, and FIG. 8 an exploded top view demonstrating the coupling of two sections 56 of support pole 54 of FIG. 6, and FIG. 9 an exploded side view demonstrating the assembly of a screw-coupled support pole 54, in accordance with preferred embodiments of the present invention. The following discussion refers to FIGS. 1, 6, 7, 8, and 9.

In order to operate as litter 24, apparatus 20 uses support poles 54. As depicted, support poles 54 are made up of three sections 56 coupled together. Those skilled in the art will appreciate that support poles 54 may be made up of other than three sections 56 without departing from the spirit of the present invention.

In the preferred embodiment of FIGS. 6, 7, and 8, pole sections 56 are coupled by bayonet couplings 90 to form support poles 54. As depicted, a center section 92 contains both bayonets 94 (i.e., the male portions of bayonet couplings 90) and end sections 96 each contain a socket 98 (i.e., the female portions of bayonet couplings 90). Bayonets 94 are inserted into sockets 98 and retained therein by the engagement of spring detents 100 into detent sockets 102. Preferably, opposing spring detents 100 are used (see FIG. 8) for strength and stability, but this is not a requirement of the present invention.

In the alternative preferred embodiment of FIG. 9, pole sections 56 are coupled by screw couplings 104 to form support poles 54. Center section 92 contains both male screws 106 and end sections 96 each contain a female screw 108. Male screws 108 are screwed into female screws 108 retained therein by friction.

Those skilled in the art will appreciate that support poles 54 should preferably be fabricated of a lightweight, rigid, and strong material, such as aluminum. Similarly, the lengths of couplings 90 or 104 should be sufficient to provide a substantial overall rigidity and strength to support poles 54 once assembled. The material of which support poles 54 are fabricated, the number of sections 56 making up support poles 54, the dimensions of couplings 90 or 104, and sections 56 have male and which female portions of couplings 90 or 104 are not requirements of the present invention. Variations in these parameters, therefore, do not depart from the spirit of the present invention.

Figure 10:
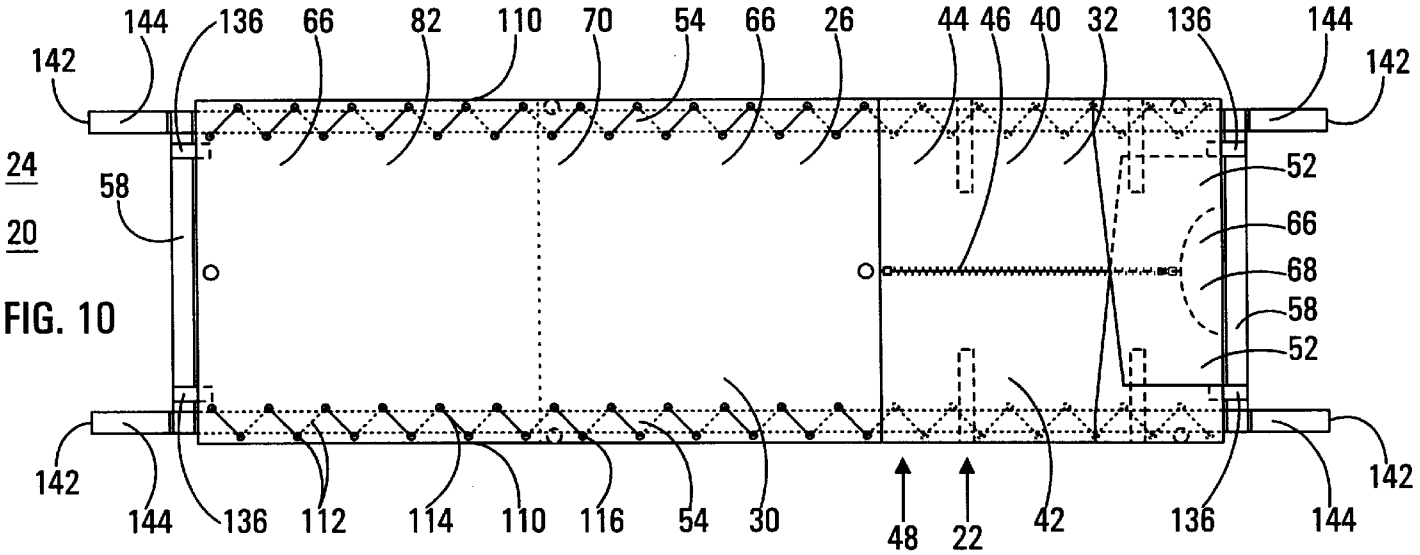
FIG. 10 depicts a top view of an apparatus, operable as a jacket and a lace-supported litter, configured for use as a litter in accordance with a preferred embodiment of the present invention.
Figure 11:
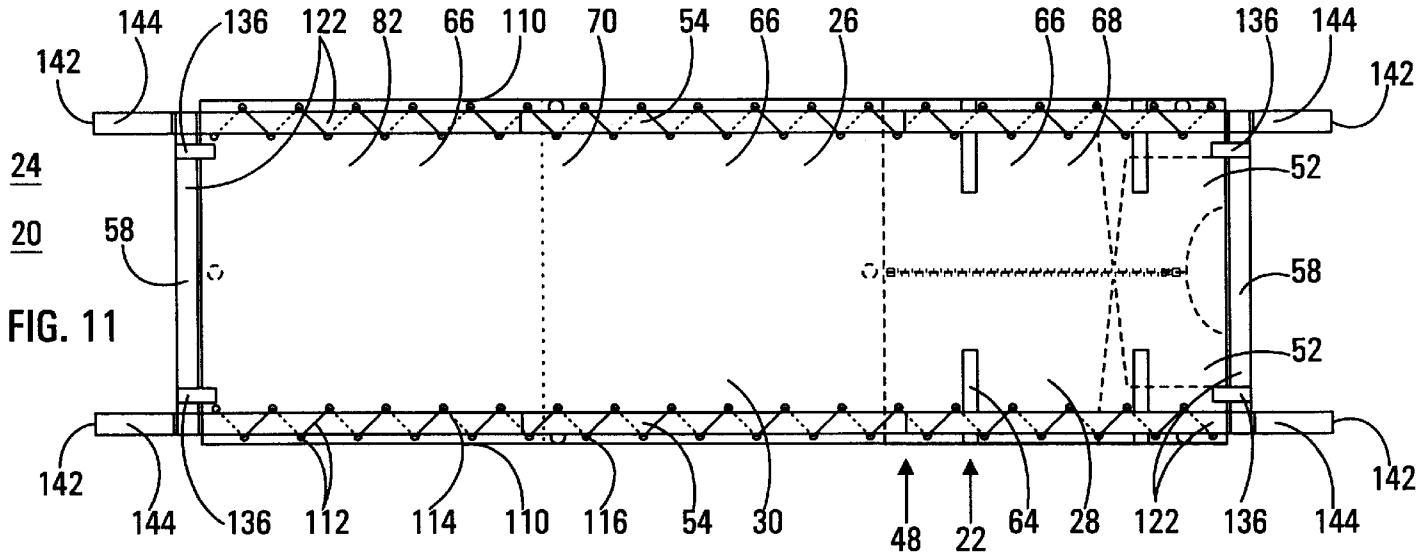
FIG. 11 depicts a bottom view of the apparatus of FIG. 10 in accordance with a preferred embodiment of the present invention.
Figure 12:
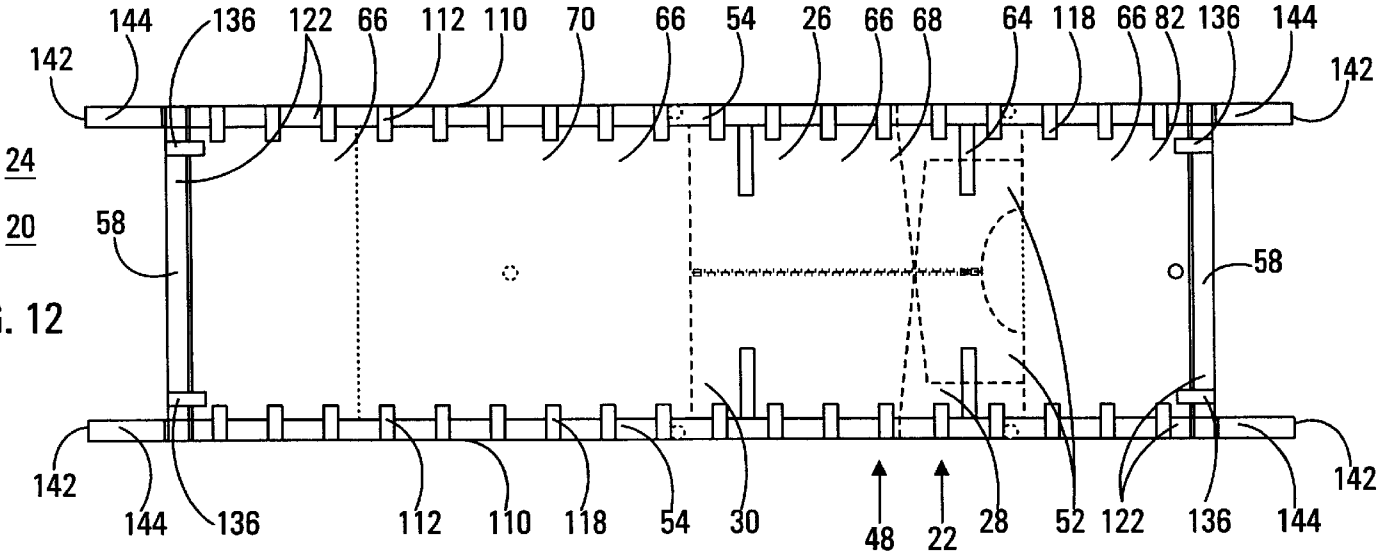
FIG. 12 depicts a bottom view of an apparatus, operable as a jacket and a loop-supported litter, configured for use as a litter in accordance with an alternative embodiment of the present invention.
Figure 13:
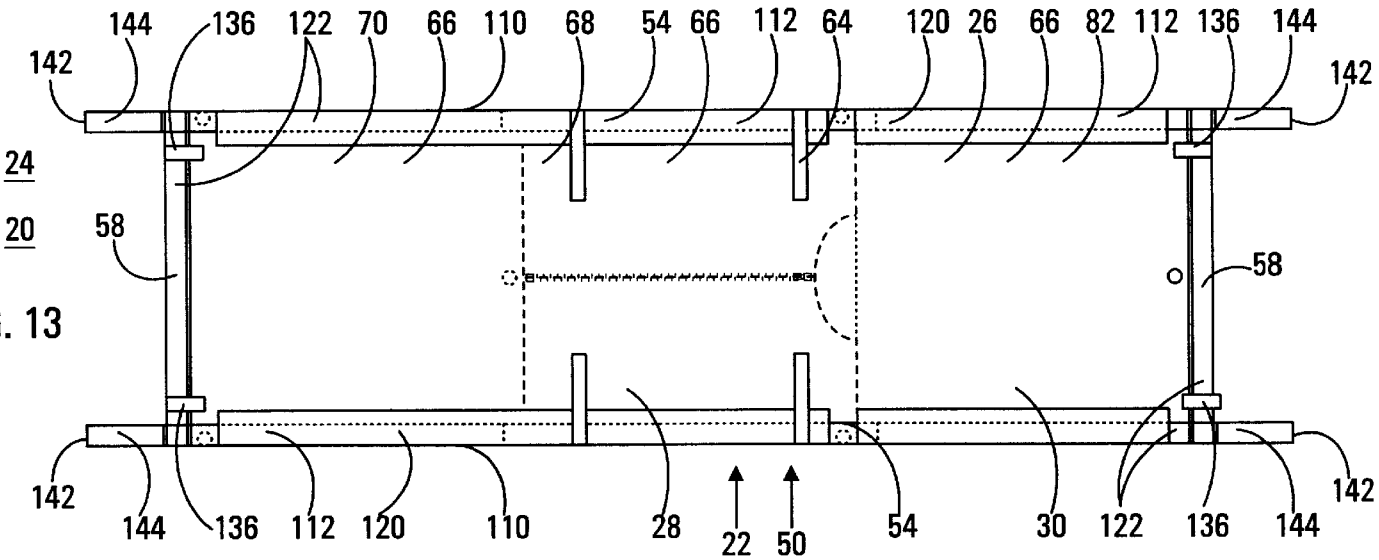
FIG. 13 depicts a bottom view of an apparatus, operable as a vest and a tube-supported litter, configured for use as a litter in accordance with another alternative embodiment of the present invention.

FIGS. 10, 11, 12, and 13 depict apparatus 20 configured as litter 24 in accordance with preferred embodiments of the present invention. FIG. 10 depicts a top view and FIG. 11 a bottom view of apparatus 20 operable as jacket 48 but currently configured as a lace-supported embodiment of litter 24. FIG. 12 depicts a bottom view of apparatus 20 operable as jacket 48 but currently configured as a loop-supported embodiment of litter 24. FIG. 13 depicts a bottom view of apparatus 20 operable as vest 50 but current configured as a tube-supported embodiment of litter 24. The following discussion refers to FIGS. 1, 6, 10, 11, 12, and 13.

To configure apparatus 20 as litter 24, sub-panels 66 of rear flexible panel 26 are unfolded and opened flat to form bed 30 of litter 24, support poles 54 are extracted from bundles 62 and assembled, and support poles 54 are coupled to sides 110 of bed 30 by support devices 112. In the preferred embodiment of FIGS. 10 and 11, support devices 112 are laces 114 and eyelets 116. Laces 114 are threaded through eyelets 116 and around support poles 54 along sides 110 of bed 30 to form a lace-supported embodiment of litter 24.

Those skilled in the art will appreciate that the pattern of eyelets 116 and the manner in which laces 114 are threaded through eyelets 116 and around support poles 54 may be varied, and that such variances do not depart from the spirit of the present invention.

Indeed, those skilled in the art will appreciate that the use of laces 114 and eyelets 116 as support devices 112 is itself not a requirement of the present invention. In the embodiment of FIG. 12, for example, support devices 112 are made up of loops 118 affixed along sides 110 of bed 30. Support poles 54 are passed through loops 118 to form a loop-supported embodiment of litter 24. Similarly, in the embodiment of FIG. 13, support devices 112 are made up of extension to sides 110 of bed that are folded over and their edges affixed to form tubes 120. Support poles 54 are passed through tubes 120 to form a tube-supported embodiment of litter 24. The use of these and other embodiments of support devices 112 does not depart from the spirit of the present invention.

Figure 15:
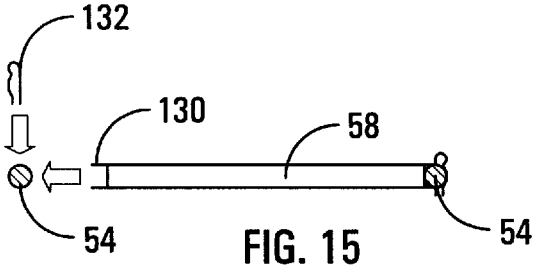
FIG. 15 depicts a partially-exploded end view demonstrating the coupling of a clip-coupled cross member between support poles in accordance with an alternative embodiment of the present invention.
Figure 14:
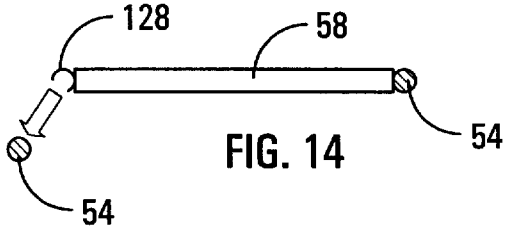
FIG. 14 depicts a partially-exploded end view demonstrating the coupling of a tension-coupled cross member between support poles in accordance with a preferred embodiment of the present invention.

FIGS. 14 and 15 depict partially-exploded end views demonstrating the couplings of cross members 58 between support poles 54 in accordance with a preferred embodiment of the present invention. FIG. 14 depicts the coupling of a tension-coupled embodiment and FIG. 15 the coupling of a clip-coupled embodiment of cross member 58. The following discussion refers to FIGS. 6, 9, 10, 11, 12, 13, 14, and 15.

For strength, comfort, and carryablity of litter 24, bed 30 should be stretched over a rectangular frame 122 made up of support poles 54 and cross members 58. If frame 122 is not used, the weight of a victim 124 being carried upon litter 24 can cause bed 30 to bow, forcing support poles 54 inward. This exerts pressure upon victim 124, producing discomfort, and potentially exacerbating the injury of which victim 124 is suffering. Additionally, bearers 126 would be obliged to exert outward lateral pressure to support poles 54 to offset the inward movement. This increases the difficulty of transporting victim 124. Accordingly, cross members 58 are coupled to support poles 54 to form frame 122 and keep support poles 54 a fixed distance apart.

In FIG. 14, cross member 58 is depicted as having a spring clip 128 affixed to each end thereof. Each of spring clips 128 is circular in cross section with a diameter substantially equal to or slightly smaller than the diameter of support pole 54, with an opening or break slightly smaller than the diameter. In this embodiment, spring clip 128 is snapped over support pole 54 to couple cross member 58 thereto.

Alternatively, in FIG. 15, cross member 58 is depicted as having a saddle 130 affixed to each end thereof. Each of saddles 130 has an opening substantially equal to or slightly larger than the diameter of support pole 54. In this embodiment, saddle 130 straddles support pole 54 and is secured in place by a retaining pin 132 passing through holes 134 in saddle 130 and support pole 54 (FIG. 9).

Those skilled in the art will appreciate that the above and other embodiments of cross members 58, support poles 54, and the manners in which cross members 58 couple to support poles 54 are not definitive, and that other embodiments may be used without departing from the spirit of the present invention.

Bed 30 is coupled to cross members 58 by suspending devices 136. In the preferred embodiment, suspending devices 136 are loops affixed to the ends 138 of bed 30. Those skilled in the art will appreciate that other forms of suspending devices 136 may be used without departing from the spirit of the present invention.

Using the embodiment of FIG. 12 as an example, apparatus 20 is configured as litter 24 by opening up rear flexible panel 26 to form bed 30, by assembling support poles 54, by inserting support poles 54 through loops 118 to support bed 30, by inserting cross members 58 through suspending devices 136, and coupling cross members 58 to support poles 54.

Figure 16:
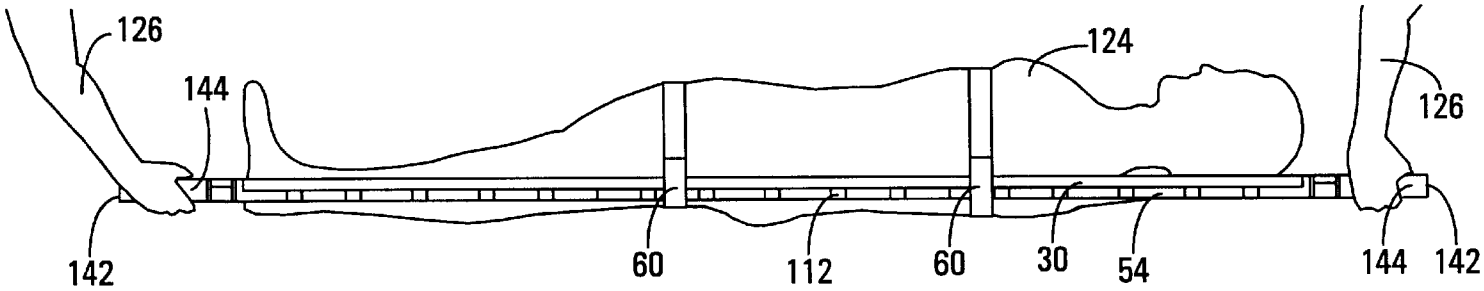
FIG. 16 depicts a side view of an apparatus operable as a vestment and a litter in use as a litter in accordance with a preferred embodiment of the present invention.
Figure 17:
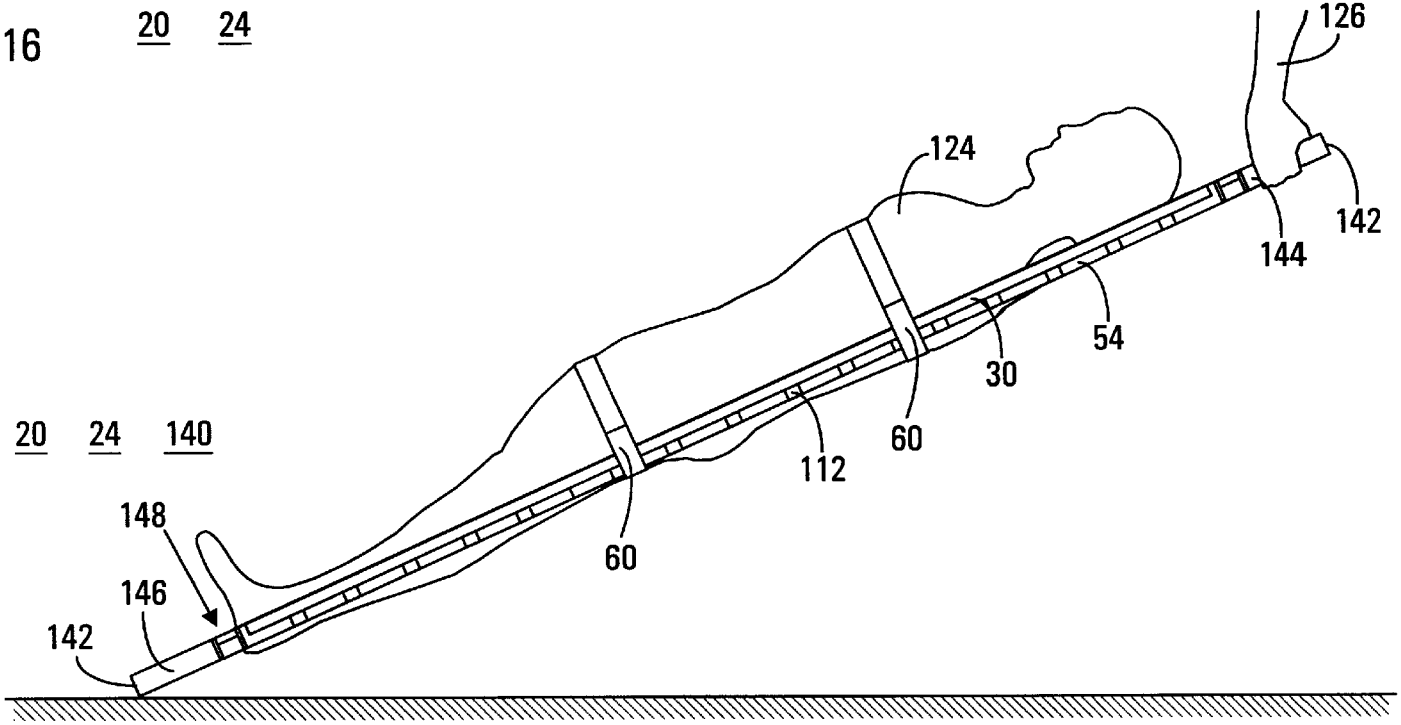
FIG. 17 depicts a side view of the apparatus of FIG. 16 in use as a travois in accordance with a preferred embodiment of the present invention.

FIGS. 16 and 17 depict side views of apparatus 20 in use as litter 24 (FIG. 16) and as a travois 140 in accordance with a preferred embodiment of the present invention. The following discussion refers to FIGS. 1, 4, 5, 16, and 17.

In normal use, apparatus 20 is configured as vestment 22 (FIGS. 4 and 5). In anticipation of possible use, wearer 88 wears vestment 22 into the field. Should victim 124 suffer illness or injury, apparatus 20 is reconfigured as litter 24 (FIG. 12). Victim 124 is then placed upon litter 24, secured with safety straps 60, and transported by bearers 126. The ends 142 of support poles 54 are equipped with or formed into handles 144 to facilitate the task of bearers 126.

If only one bearer 126 is available, then litter 24 is used as a travois 140. When used as travois 140, one pair of pole ends 142 serve as skids 146 and the other pair of pole ends 142 as handles 144. Skids 146 are provided by making the appropriate ends 142 of support poles 54 from a hard material that offers minimal friction when dragged over the ground. Handles 144 may be integral with support poles 54 and themselves be skids 146 formed of this hard material, or handles 144 may be placed over the ends of support poles 54 and removed to reveal skids 146. Because of the slope of litter 24 when used as travois 140, it may be desirable to configure one cross member 58 as a footrest 148 for victim 124. In this way, victim 124 will be prevented from sliding down in travois 140. For example, footrest 148 may, but need not, have a broad flat region (not shown) upon which the feet of victim 124 would rest.

The following discussion refers to FIGS. 11, 12, and 13. If vestment 22 is configured as jacket 48 and first sub-panel 68 is located at one end of bed 30 (FIG. 11), then sleeves 52 may be folded over, and optionally stuffed with leaves, clothing, or other substances, to act as a pillow or cushion for the head of victim 124. Alternatively, if first sub-panel 68 is located slightly down from one end 138 of bed 30 (FIG. 12) then the small sub-panel 66 above first sub-panel 68 may serve as a head panel, and vestment 22 may be worn by victim 124 to prevent victim 124 from sliding down travois 140 and/or as a protection against chill or wet. Also, if first sub panel 68 is a central sub-panel 66 in bed 30 (FIG. 13), then sleeves 52 may be used as additional safety straps 60 to secure victim 124 into litter 24.

The hereinabove discussed and other embodiments of apparatus 20 operating as vestment 22 (FIGS. 4 and 5) provide a comfortable and convenient way of transporting litter 24 into the field. Vestment 22 supports an integral litter 24 in a manner that produces minimal interference with the activities of wearer 88. This makes apparatus 24 ideal for use by hunters, hikers, backpackers, mountain climbers, spelunkers, skiers, explorers, rescue personnel, and the military. Also, apparatus 20, when configured as litter 24, is usable for transporting game, equipment, or supplies that may otherwise be overly cumbersome or heavy.

In summary, the present invention teaches an apparatus 20 operable as a vestment 22 and a litter 24. Apparatus 20 itself is transportable as vestment 22 and may be used on demand as litter 24. The use of sectional support poles 54 allow poles 24 to be bundled within vestment 22 is a practicable manner which does not substantially interfere with the activities of a wearer 88.

Although the preferred embodiments of the invention have been illustrated and described in detail, it will be readily apparent to those skilled in the art that various modifications may be made therein without departing from the spirit of the invention or from the scope of the appended claims.

What is claimed is:

1. An apparatus operable as both a vestment and a litter, said apparatus comprising:

a first flexible panel serving as both a back of said vestment and as a bed of said litter, wherein said first flexible panel comprises:

a first sub-panel having an upper edge and a lower edge, said first sub-panel being coupled to said front;

a second sub-panel having an upper edge and a lower edge, said upper edge of said second sub-panel being coupled to said lower edge of said first sub-panel; and a fastener configured to detachably couple said lower edge of said second sub-panel proximate said upper edge of said first sub-panel;

a second flexible panel coupled to said first flexible panel and configured as a front of said vestment;

a pair of support poles for supporting said first flexible panel when said apparatus is configured as said litter; and a support device coupled to said first flexible panel, said support device being for supporting said first flexible panel from said support poles when said apparatus is configured as said litter.

2. An apparatus as claimed in claim 1 wherein said first flexible panel additionally comprises:

a third sub-panel having a first edge and a second edge, said first edge of said third sub-panel being coupled to one of said upper edge of said first sub panel and said lower edge of said second sub-panel; and a fastener configured to detachably couple said second edge of said third sub-panel to said second sub-panel.

3. An apparatus operable as a litter and transportable as a vestment, said apparatus comprising:

a first flexible panel configured to serve as a bed of said litter and as a back of said vestment, wherein said first flexible panel comprises a plurality of fixedly coupled sub-panels wherein:

said sub-panels are extended to form said bed when said apparatus is configured as said litter;

said sub-panels are folded to form said back when said apparatus is configured as said vestment; and said sub-panels have a plurality of fasteners configured to maintain said sub-panels in said folded configuration when said apparatus is configured as said vestment;

a pair of support poles for supporting said bed when said apparatus is configured as said litter;

a support device coupled to said bed and configured to support said bed from said support poles when said apparatus is configured as said litter; and a second flexible panel coupled to said first flexible panel and configured to serve as a front of said vestment when said apparatus is configured as said vestment.

4. An apparatus operable as both a vestment and a litter, said apparatus comprising:

a first flexible panel configured as a front of said vestment;

a second flexible panel coupled to said first flexible panel and serving as both a back of said vestment and as a bed of said litter, said second flexible panel comprising:

a first sub-panel having an upper edge and a lower edge, said first sub-panel being coupled to said front;

a second sub-panel having an upper edge and a lower edge, said upper edge of said second sub-panel being coupled to said lower edge of said first sub-panel; and a fastener configured to detachably couple said lower edge of said second sub-panel proximate said upper edge of said first sub-panel;

a pair of support poles for supporting said second flexible panel when said apparatus is configured as said litter; and a support device coupled to said second flexible panel, said support device being for supporting said second flexible panel from said support poles when said apparatus is configured as said litter.

5. An apparatus as claimed in claim 4 wherein said first flexible panel additionally comprises:

a third sub-panel having a first edge and a second edge, said first edge of said third sub-panel being coupled to one of said upper edge of said first sub panel and said lower edge of said second sub-panel; and a fastener configured to detachably couple said second edge of said third sub-panel to said second sub-panel.

* * * * *